US005154195A

United States Patent [19]

Irisawa

[11] Patent Number: 5,154,195

[45] Date of Patent: Oct. 13, 1992

[54] METHOD OF ATTACHING HAIRPIECE AND HAIRPIECE ATTACHING ELEMENT

[75] Inventor: Manabu Irisawa, Tokyo, Japan

[73] Assignee: Hexa Process Corporation, Tokyo, Japan

[21] Appl. No.: 630,326

[22] Filed: Dec. 19, 1990

[30] Foreign Application Priority Data

Jan. 16, 1990 [JP] Japan ..... 2-6902

[51] Int. Cl.[5] ..... A41G 3/00

[52] U.S. Cl. ..... 132/201; 132/53; 132/54

[58] Field of Search ..... 132/53, 54, 56, 105, 132/106, 127, 200, 201

[56] References Cited

U.S. PATENT DOCUMENTS

| | | | |
|---|---|---|---|
| 613,145 | 10/1898 | Herrick et al. | 132/105 X |
| 1,686,636 | 10/1928 | Oppenheim | 132/53 X |
| 2,620,809 | 12/1952 | Rosen | 132/53 |
| 3,699,978 | 10/1972 | Holly | 132/53 |
| 3,889,694 | 6/1975 | Greer | 132/53 |
| 4,168,713 | 9/1979 | Agiotis | 132/53 |
| 4,360,033 | 11/1982 | Schmehling | 132/53 |

FOREIGN PATENT DOCUMENTS

| | | | |
|---|---|---|---|
| 2500170 | 7/1976 | Fed. Rep. of Germany | 132/53 |
| 56-23295 | 6/1981 | Japan . | |
| 62-141107 | 6/1987 | Japan . | |

*Primary Examiner*—John J. Wilson
*Assistant Examiner*—Jeffrey A. Smith
*Attorney, Agent, or Firm*—Wenderoth, Lind & Ponack

[57] ABSTRACT

A method of attaching a hairpiece and a hairpiece attaching element are disclosed. The method has the steps of: providing an anchor around the outer periphery of a hairpiece body and the hairpiece attaching element which includes a core and a cover slidably fitting on the core, the core having a first engagement means engaging the anchor and a second engagement means engaging bundles of a plurality of natural growing hairs growing from the head of a wearer; engaging the anchor with the first engagement means; and then moving the cover so that the bundles of natural growing hairs engage the second engagement means so as to cover the natural growing hairs engaging the core and retain the engagement of the natural growing hairs.

10 Claims, 4 Drawing Sheets

FIG. 5
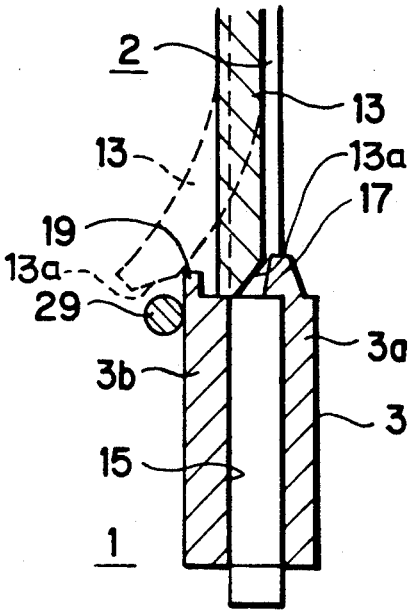
FIG. 6B
FIG. 6A
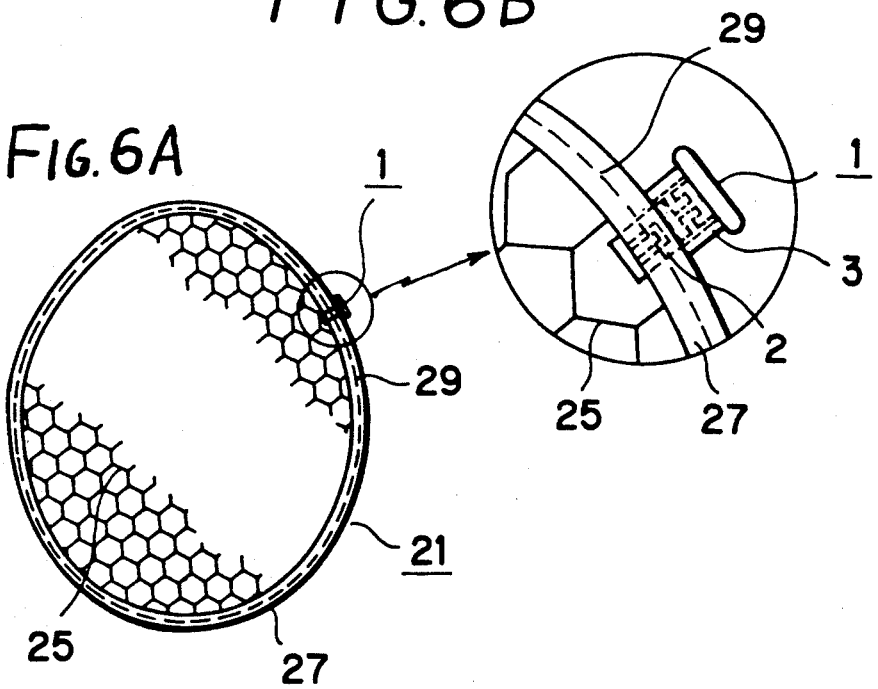

METHOD OF ATTACHING HAIRPIECE AND HAIRPIECE ATTACHING ELEMENT

BACKGROUND OF THE INVENTION

1. Field of the Invention

The present invention relates to a method of attaching a hairpiece and a hairpiece attaching element, and especially to a method of attaching a plurality of hairpiece attaching elements to the outer periphery of the body of a hairpiece and engaging bundles of a plurality of natural hairs grown from the head of a wearer with the hairpiece attaching elements to attach the hairpiece to the head of the wearer, and to a hairpiece attaching element therefor.

2. Description of the Related Art

Conventionally, hairpieces have been provided as a means for adding artificial hair to natural hair. These hairpieces are conventionally fastened with an adhesive or metal fitting or the like. Japanese examined utility model application publication SHO 56-23295, U.S. Pat. No. 3,871,389, etc. have proposed a hairpiece having artificial hairs attached to each side of each polygonal opening of a mesh and extending towards the center of the polygonal opening. In addition, Japanese unexamined patent application publication SHO 62-141107 filed by the present application has proposed a hexagonal-intertwining type artificial hair adding method.

In a prior art method of attaching a hairpiece with an adhesive or the like, there is a drawback in that it gives the wearer an ill fit feeling since it prevents dermal respiration of the skin of the wearer's head. On the other hand, in a prior art method of attaching a hairpiece with a metal fitting or the like, there is a drawback that it may be heavy, and a shampoo, swimming or other vigorous sports may displace the hairpiece, so that it is unsuitable for these situations, and a wearer cannot be assured that it will always remain attached. In addition, there is a drawback that the wearer cannot easily scratch the head with his finger when itching occurs.

The intertwining type artificial hair adding method proposed by the present applicant has a problem in that the work of attaching the hairpiece is troublesome and a wearer cannot easily and quickly attach the hairpiece since the wearer must bundle a plurality of his own natural hairs and sequentially intertwine these bundled hairs with a plurality of threads to provide a hairpiece attaching means.

SUMMARY OF THE INVENTION

An object of the present invention is to provide a method of attaching a hairpiece and a hairpiece attaching element therefor which has none of the above drawbacks but which permits the hairpiece to be easily and quickly attached, will not damage natural hairs of a wearer, requires no skill in the attachment and detachment of the hairpiece, assures a good fit of the hairpiece and is economically superior to prior art methods.

In order to achieve the above object, one embodiment of the method of the present invention comprises the steps of providing an anchor around the outer periphery of a hairpiece body, and a hairpiece attaching element including a core and a cover slidably fitting on the core, the core having a first engagement means engaging the anchor and a second engagement means for engaging bundles of a plurality of natural hairs grown from the head of a wearer; engaging the anchor with the first engagement means and then moving the cover so that the bundles of the natural hairs engage the second engagement means and covering the natural hairs engaging the core to retain the engagement of the natural hairs.

An embodiment of the hairpiece attachment element of the present invention comprises a slender core made of a synthetic plastic material and a cover fitting round and movable along the surface of the core, the core having a first engagement means for engaging the outer periphery of a hairpiece body, the outer periphery of a front end of the core having a second engagement means for engaging bundles of a plurality of natural hairs grown from the head of a wearer, the cover being movable to the second engagement means for retaining the engagement of the bundles of natural hairs with the second engagement means.

The method and element for attaching the hairpiece facilitate the easy and quick attachment of the hairpiece to the head of the wearer without damage to the natural hairs.

BRIEF DESCRIPTION OF THE DRAWINGS

FIG. 5 is a longitudinal section through a part of the hairpiece attaching element;

FIG. 6A is a plan view of a hairpiece body;

FIG. 6B is an enlargement of an encircled part of FIG. 6A;

DESCRIPTION OF THE PREFERRED EMBODIMENTS

The preferred embodiments of a method of attaching a hairpiece and a hairpiece attaching element of the present invention will be described hereinafter with reference to the drawings.

FIGS. 1–5 illustrate a hairpiece attaching element according to the invention and used with a method of attaching a hairpiece according to the invention. The hairpiece attaching element 1 comprises a flat and essentially rectangular core 2 made of a synthetic plastic material, e.g. nylon or polyacetal, and a cover 3 fitting around and movable along the surface of the core 2. The cover 3 is also made of a synthetic plastic material. More particularly, both the core 2 and cover 3 are preferably made of a colored synthetic plastic material, i.e. black, brown or gold.

Figure 1:
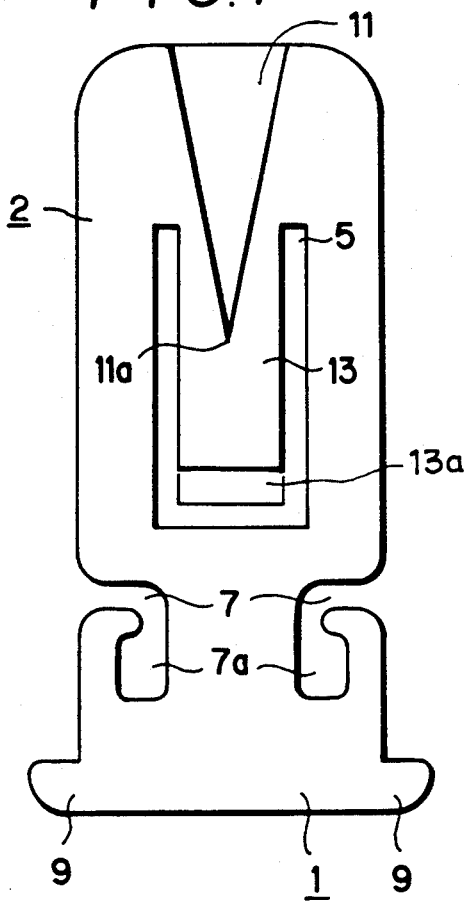
FIG. 1 is a front view of the core of a hairpiece attaching element of an embodiment of the present invention.
Figure 2:
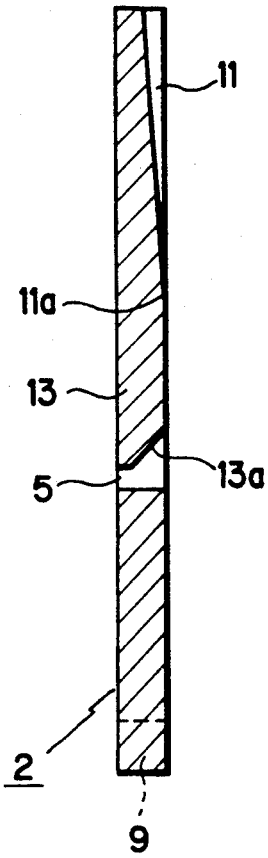
FIG. 2 is a longitudinal section through the core of the hairpiece attaching element.

FIGS. 1 and 2 illustrate the core 2. The core 2 has dimensions of about 15 mm in length, about 6 mm in width and about 1 mm in thickness. A central part of the core 2 has an approximately U-shaped first engagement slot 5 extending through the thickness of the core 2 and forming part of a first engagement means. On each side edge toward the front part of the core 2 is an essentially L-shaped second engagement slot 7 extending towards the central longitudinal axis of and then toward the front edge of the core 2, so that the second engagement slot 7 includes an axially extending front portion 7*a*. The second engagement slot 7 constitutes a second engagement means for engaging bundles of a plurality of natural hairs 31 grown from the head 22 of a wearer (see FIG. 7). The second engagement slot 7 may omit the axial portion 7*a* and extend obliquely instead of being the essentially L-shaped form.

Each side of the core 2 at the front edge thereof has a stop 9 extending outwards transversely to the axis of the core 2 for stopping axial movement of the cover 3 above the core. An axially central area of the rear portion of the core 2 has a guiding groove 11 therein in the shape of an isosceles triangle and tapering towards an apex 11*a* toward the front edge of the core 2. The apex of the isosceles triangle of the guiding groove 11 extends into a tongue 13 defined by the U-shaped first engagement slot 5. As shown in FIG. 2, the front end of the tongue 13 has an oblique surface 13*a*. The width of the first engagement slot 5 is about 0.5 mm. The width of the narrowest portion of the second engagement slot 7 is also about 0.5 mm.

Figure 3:
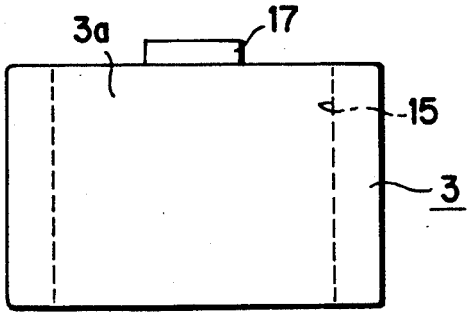
FIG. 3 is a front view of a cover of the hairpiece attaching element.
Figure 4:
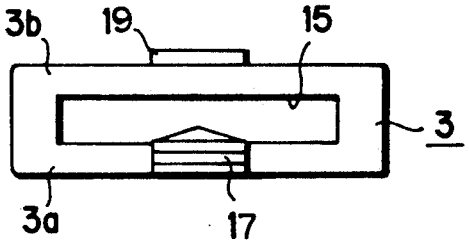
FIG. 4 is an end view of the cover of the hairpiece attaching element.

FIGS. 3 and 4 illustrate the annular cover 3 having a shape defining an axial rectangular through-hole 15 of a size for fitting around the core 2. The cover 3 is fitted on the core 2 so that the front edge of the cover 3, at the bottom in FIG. 3, has a tab 17 extending upwards and adapted to extend into and be guided by the bottom wall of the guiding groove 11 defined in the core 2. As best shown in FIG. 5, the tab 17 extends from the rear edge of the top side 3*a* of the cover 3 into the through-hole 15 and pushes the tongue 13 of the core 2 toward the bottom of the rear side 3*b* of the cover 3. The lower edge of the rear side 3*b* of the cover 3 has a tab-shaped stop 19 extending outwards (upward in FIG. 5) and normally retaining the tongue 13 within a normal range of movement. Each of the core 2 and cover 3 preferably has a cross section with a rounded edge contour without angular edges.

Figure 7A:
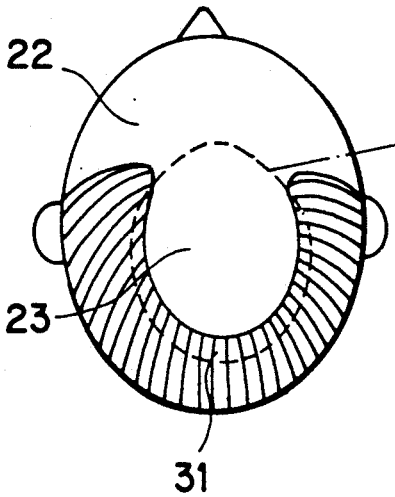
FIG. 7A is an illustrative plan view of the hairpiece body of FIG. 6A attached to the head of a wearer.
Figure 7B:
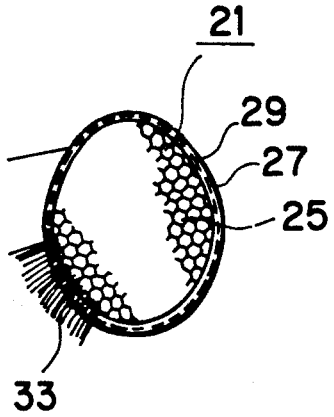
FIG. 7B is a detailed view of a part of FIG. 7A indicated by a broken line shown therein.

FIG. 6A illustrates a hairpiece body 21. FIG. 7A illustrates a position of the hairpiece body 21 attached to a bald area 23 of the head 22 of the user. The hairpiece body 21 comprises a hexagonally-apertured mesh 25, a border 27 sewn on the outer edge of the mesh 25 and a continuous annular anchor 29 or a plurality of discrete anchors 29 provided on the underside of the border 27. The present embodiment has employed the hexagonally-apertured mesh 25. Alternatively, a quandrangularly-apertured mesh or a mesh including apertures of a convenient shape may be employed. In summary, a mesh aperture need only have a shape for connecting or attaching artificial hairs or natural hairs 33 such as china hairs.

Each of the anchors 29 provided on the border 27 is made of polyester filaments or the like with a 0.5 mm cross-sectional diameter. The diameter of the cross section of each filament may be 0.3–0.8 mm.

Figure 8:
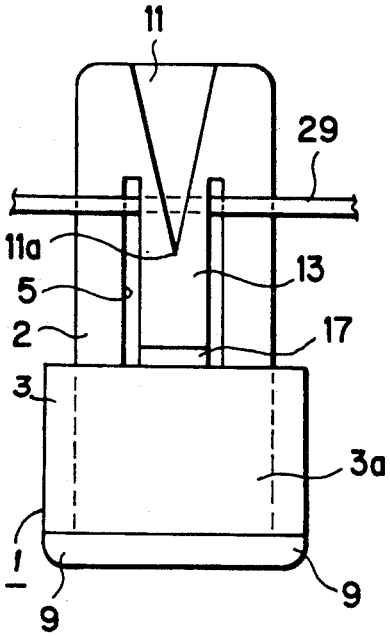
FIGS. 8–10 are front views illustrating the steps of the method of attaching a hairpiece according to the invention.
Figure 9:
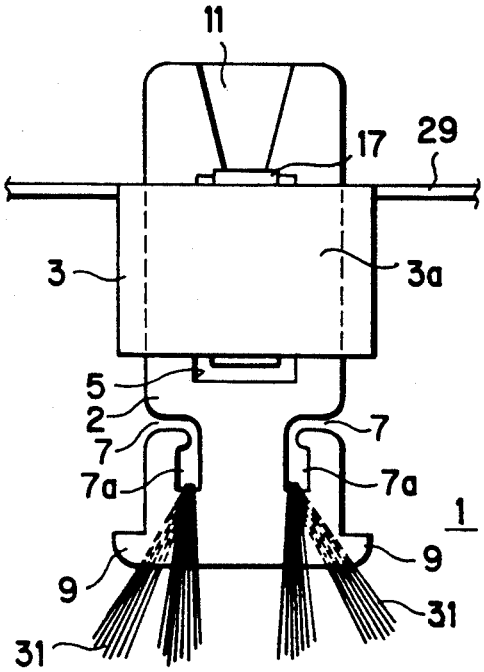
Figure 10:
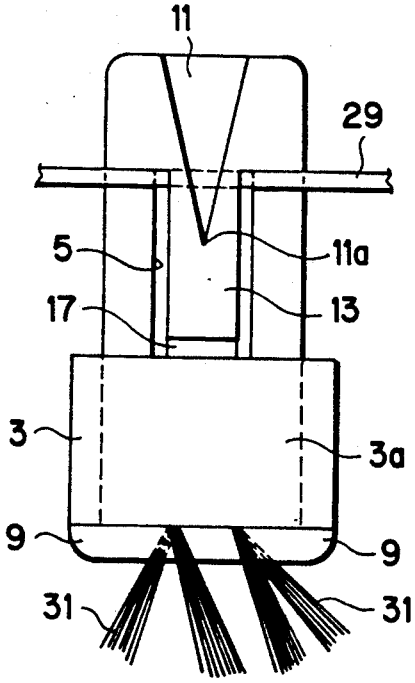

FIGS. 8–10 illustrate the steps of a method of attaching a hairpiece by means of the hairpiece attaching element 1.

As shown in FIG. 8, with the cover 3 moved forwardly against the stops 9, the anchors 29 of the hairpiece body 21 are first engaged in the first engagement slot 6 and under the tongue 13 defined in the core 2. As shown in dash lines in FIG. 5, the tongue 13 of the core 2 is first bent so that the front edge of the tongue 13 moves past the stop 19. Then the anchors 29 are passed through the narrow space between the outer edge of the stop 19 and the oblique surface 13*a* of the tongue 13. Then the tongue 13 is returned inside the stop 19 by its own elasticity so as to move the anchors 29 into the first engagement slot 5 in the core 2. Thus, the hairpiece attaching element 1 is completely attached to the border 27 of the hairpiece body 21. During this time, the cover 3 is at a position over the second engagement slot 7 of the core 2 and, as shown in FIG. 5, the front edge of the tongue 13 abuts the top edge of the rear side 3*b* of the cover 3 so as to block rearward movement of the cover 3.

As shown in FIG. 9, the core 2 and thereby the tongue 13 are bent so that the tongue 13 passes into the through-hole 15 of the cover 3. The cover 3 is moved rearwardly on the core to a position over first engagement slot 5 in the core 2. Bundles of a plurality of the natural growing hairs 31 growing from the head 22 of the user are engaged in the open second engagement slots 7. The second engagement slots 7 may receive and engage a single looping bundle of the natural growing hairs 31. Alternatively, the second engagement slots 7 may receive and engage different bundles of the natural growing hairs 31. The bundles of the natural growing hairs 31 engage the front portions 7*a* of the second engagement slots 7.

As shown in FIG. 10, the cover 3 is then moved to a position over the second engagement slots 7 of the core 2 so that the cover 3 and the core 2 tightly sandwich the bundles of the natural growing hairs 31 and bend them generally toward the front end of core 2. When the cover 3 has been completely moved to the second engagement slot 7 end of the core 2, the portion of the tab 17 extending into the through-hole 15 pushes the tongue 13 to the rear side 3*b* of the cover 3. When the front edge of the cover 3 abuts the stops 9 provided at the front edge of the cover 2, the front edge of the tongue 13 abuts the rear edge of the cover 3 so as to stop the axial movement of the cover 3, as best seen in FIG. 5.

Thus, by attaching a plurality of, e.g. 6–10 hairpiece attaching elements to the outer periphery of the hairpiece body 21, a hairpiece can be attached to the bald area 23 of the head 22 of the wearer.

The above embodiment has described a case in which the U-shaped first engagement slot 5 and the tongue 13 together provide the first engagement means. The present invention is not restricted to this case but is also applicable to a case in which the front or rear surface of the core 2 has an elastic tongue for engaging the anchors 29. In the latter case, a portion of the cover 3 opposite the tongue defines a slot or opening for guiding the axial sliding of the cover 3.

What is claimed is:

1. A method of attaching a hairpiece having an anchor means around the periphery thereof, comprising the steps of:

providing a hairpiece attaching element which includes a core and a cover slidably mounted on the core, the core having a first engagement means located toward one end thereof for engaging the anchor means and a second engagement means located toward the other end thereof for engaging bundles of a plurality of natural growing hair growing from the head of a wearer;

placing a hairpiece over a bald spot of a wearer with the natural growing hair of the wearer extending generally away from the periphery of the hairpiece;

engaging the first engagement means with the anchor and positioning the attaching element so that it extends generally away from the periphery of the hairpiece in the direction of the natural growing hair of the wearer;

engaging bundles of natural growing hair of the wearer and the second engaging means so that the free ends of the hairs in the bundle project outwardly of the attaching element; and moving the cover toward the other end of the core for securing the natural growing hairs of the wearer in the second engagement means and for causing the natural growing hairs projecting outwardly of the attaching element to be bent toward the other end of the core in the general direction in which the natural growing hairs extend away from the periphery of the hairpiece.

2. A method of attaching a hairpiece as recited in claim 1, wherein the anchor means has a continuous annular form.

3. A method of attaching a hairpiece as recited in claim 1, wherein the anchor means comprises a plurality of discrete anchors distributed around the outer periphery of the hairpiece body.

4. A hairpiece attaching element for attaching a hairpiece having an anchor means around the periphery thereof to natural growing hair on the head of a wearer of the hairpiece, said attaching element comprising:

a core having opposite ends and a cover slidably mounted on said core and slidable toward and away from the respective opposite ends, said core having a U-shaped slot defined in said core located toward one end of said core and passing through the thickness of said core, and a tongue defined by said slot for engaging the anchor means of the hairpiece, and a second engagement means located toward the other end of the core for engaging bundles of a plurality of natural growing hairs growing from the head of the wearer, said cover being slidable from a position past said second engagement means in the direction toward said one end of said core toward said other end of the core over said second engagement means for securing the natural growing hairs in said second engagement means and for causing natural growing hairs of the bundles which project beyond the core to be bent toward the other end of the core.

5. A hairpiece attaching element as claimed in claim 4 in which said core is made of plastic material.

6. A hairpiece attaching element as recited in claim 4, wherein the second engagement means comprises engagement slots defined in opposite sides of said core.

7. A hairpiece attaching element as recited in claim 4, wherein the second engagement means comprises engagement slots defined in opposite sides of said core.

8. A hairpiece attaching element as recited in claim 4, wherein said core is a flat plate.

9. A hairpiece attaching element as recited in claim 8, wherein the second engagement means comprises engagement slots defined in opposite sides of said core.

10. A hairpiece attaching element as recited in claim 4, wherein the second engagement means comprises engagement slots defined in opposite sides of said core.

* * * * *